US008451136B2

(12) United States Patent
Jaques et al.

(10) Patent No.: US 8,451,136 B2
(45) Date of Patent: May 28, 2013

(54) SONDE ATTACHMENT MEANS

(75) Inventors: Paul Steven Jaques, St. Ives (GB); Robert Hughes Jones, Fen Drayton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 916 days.

(21) Appl. No.: 11/720,067

(22) PCT Filed: Nov. 28, 2005

(86) PCT No.: PCT/IB2005/003560

§ 371 (c)(1),
(2), (4) Date: May 23, 2007

(87) PCT Pub. No.: WO2006/059197

PCT Pub. Date: Jun. 8, 2006

(65) Prior Publication Data

US 2008/0079605 A1 Apr. 3, 2008

(30) Foreign Application Priority Data

Nov. 30, 2004 (GB) ..... 0426183.0

(51) Int. Cl.

| | |
|---|---|
| ***G01V 3/18*** | (2006.01) |
| ***E21B 47/01*** | (2006.01) |
| ***E21B 1/00*** | (2006.01) |
| *E21B 15/00* | (2006.01) |

(52) U.S. Cl.

CPC . *E21B 47/01* (2013.01); *E21B 1/00* (2013.01); *E21B 15/00* (2013.01)

USPC ..... 340/853.1; 340/856.3; 340/856.4; 166/250.1; 166/66

(58) Field of Classification Search

CPC ..... E21B 47/01

USPC ..... 340/853.1, 856.3, 856.4; 166/250.1, 166/66

See application file for complete search history.

(56) References Cited

U.S. PATENT DOCUMENTS

| | | | | |
|---|---|---|---|---|
| 614,892 | A * | 11/1898 | Shafer et al. | 220/623 |
| 2,786,987 | A | 3/1957 | Jolly | |
| 5,092,423 | A | 3/1992 | Petermann | |
| 5,111,903 | A | 5/1992 | Meynier | |
| 5,181,565 | A | 1/1993 | Czernichow | |
| 5,200,581 | A | 4/1993 | Boyle et al. | |
| 5,255,245 | A * | 10/1993 | Clot | 367/25 |
| 5,318,129 | A | 6/1994 | Wittrisch | |
| 5,509,474 | A * | 4/1996 | Cooke, Jr. | 166/64 |
| 6,173,804 | B1 * | 1/2001 | Meynier | 181/102 |
| 6,179,055 | B1 * | 1/2001 | Sallwasser et al. | 166/254.2 |
| 6,247,542 | B1 * | 6/2001 | Kruspe et al. | 175/40 |

(Continued)

FOREIGN PATENT DOCUMENTS

| | | |
|---|---|---|
| EP | 0943782 | 9/1999 |
| EP | 1370891 | 11/2006 |
| WO | WO 03027717 A1 * | 4/2003 |

*Primary Examiner* — Hai Phan
*Assistant Examiner* — Amine Benlagsir
(74) *Attorney, Agent, or Firm* — Jianguang Du; Robin Nava

(57) ABSTRACT

A sonde for installation in a well including a clamp (2) for engaging with the inner wall of a well casing (3) and securing device for securing the clamp to inner tubing of the well, whereby the securing device includes an attachment device (5, 6) for connection to the inner tubing and a rod (4) connected between the clamp and the attachment device.

14 Claims, 2 Drawing Sheets

U.S. PATENT DOCUMENTS 6,289,985 B1 9/2001 Meynier
6,497,279 B1 * 12/2002 Williams et al. ..... 166/250.01
6,693,554 B2 * 2/2004 Beique et al. ..... 340/856.3
6,850,462 B2 * 2/2005 McDaniel et al. ..... 367/35
6,896,063 B2 * 5/2005 Chang et al. ..... 166/386
7,124,818 B2 * 10/2006 Berg et al. ..... 166/250.01
7,334,661 B2 * 2/2008 Pabon et al. ..... 181/108
7,673,682 B2 * 3/2010 Daily ..... 166/254.2
2002/0060095 A1 * 5/2002 Wentworth et al. ..... 175/73
2003/0179651 A1 * 9/2003 Nutt et al. ..... 367/25
2004/0114463 A1 * 6/2004 Berg et al. ..... 367/14
2004/0194956 A1 * 10/2004 Haheim et al. ..... 166/250.11
2004/0223410 A1 * 11/2004 West et al. ..... 367/25

* cited by examiner

SONDE ATTACHMENT MEANS

This invention relates to a sonde for installation in a well, a well assembly comprising such a sonde, and methods for installing acoustic sensing equipment in a well and sensing acoustic vibration in a well.

BACKGROUND

Microseismic analysis of the geological strata around the bore of fluid injection and production wells is typically effected by the use of seismic sensor assemblies (sondes), mounted downhole in the area of the fluid flow. Usually a number of sondes are mounted in the well at different levels in the bore. Deployment techniques have been developed to allow the sensors to become almost completely mechanically decoupled from the flow induced noise from the tubing.

Systems for permanently installing a sonde against an inner wall of a pipe, such as the casing of a fluid extraction well, are known. Such systems are described in, for example, U.S. Pat. Nos. 5,092,423, 5,181,565, 5,200,581, 5,111,903, 6,289,985, 6,173,804 and 5,318,129.

Typically, a sonde comprises a clamp which permanently or semi-permanently engages with the inner casing of a well. For example, the clamp may be lowered into the well in a retracted state and then once in position activated to engage with the well casing using a pressure actuated system, which may use external pressure sources or well pressure. Such a clamp is described in patent application no. EP-A-1370891, the contents of which are incorporated herein by reference, which describes C-shaped ring clamps. It is also possible to activate the clamp near the top of the well, and simply drag it down the well, acting against friction between the clamp and well casing, into the desired position.

A disadvantage of these systems is that because the sondes (for example with C-shaped ring clamps) are released from the tubing and clamped to the inside of the casing, any large tubing movement, i.e. typically more than 15 cm, can cause the risk of coupling the sondes back to the tubing. Such movement is invariably axial or rotational. These systems only perform at their best when the tubing movement is small. Small movements can also be accommodated by the wires from the sensors mounted on the casing and running up the tubing, whereas large movements will result in breakage of these wires.

Well completions differ significantly from well to well and temperature changes cause thermal expansion to the installed tubing. Completions have to be designed to allow for the tubing axial or rotational movement, and this can be done by the installation of a seal bore packer for example.

For well completions of this type where tubing movement occurs, it would therefore be preferable to provide a means of allowing the sondes to move along the inside of the casing when the tubing moves while maintaining good mechanical decoupling.

With such an arrangement, the sondes must be able to move along the axis of the borehole when the tubing moves, this tubing movement being possible in either direction. Therefore, the sonde must be secured to the tubing by some mechanical means which must have the following properties:

a) it is strong enough to allow the sonde to be dragged along the casing;
b) it does not change the frequency properties of the sonde by changing or adding unwanted resonance; and
c) most importantly, it does not provide a path for flow noise from tubing to sonde.

It is an object of the present invention to provide a sonde having such securement means.

SUMMARY OF THE INVENTION

In accordance with a first object of the present invention there is provided a sonde for installation in a well comprising a clamp for engaging with the inner wall of a well casing and securing means for securing the clamp to inner tubing of the well, characterised by the securing means comprising attachment means for connection to the inner tubing and a rod connected between the clamp and the attachment means.

Advantageously, the dimensions and/or material of the rod are selected so as to minimise transfer of noise from the tubing to the sonde.

The securing means preferably comprises a plurality of such rods. With this arrangement, at least one such rod and attachment means may be provided on each side of the clamp along the axis of the well.

Advantageously, the attachment means is soft mounted to the tubing.

The attachment means may comprise electrical distribution means enabling electrical connection between the sonde and wellhead components, the electrical distribution means being fixed relative to the sonde.

The clamp may be substantially C-shaped.

Preferably, the clamp carries a sensor. The sensor may be electrically connected to the electrical distribution means.

In accordance with a second aspect of the present invention, there is provided a well assembly comprising a well, a well casing lining the wall of the well, tubing extending internally through the well and a sonde in accordance with the first aspect of the invention.

In accordance with a third aspect of the present invention, there is provided a method of installing acoustic sensing equipment in a well, comprising the steps of:

providing a sonde in accordance with any preceding claim,
fitting the sonde to the inner tubing of a well while the clamp is in a retracted state,
expanding the clamp so that it contacts the inner wall of the well casing, and
pushing the sonde along the well to its desired position.

In accordance with a fourth aspect of the present invention, there is provided a method of sensing acoustic vibration in a well, comprising the steps of:

providing a sonde in accordance with any preceding claim,
installing the sonde at a desired position in the well so that acoustic sensing equipment carried by the sonde is held against the inner wall of the well casing.

Thus the object of the invention is achieved by connecting at least one rigid "tether rod" between the sonde and the tubing. A plurality of such rods may be fitted above and below the sonde and attach on to this tubing at soft mounted interfaces above and below the sonde.

The cross sectional area of the rods must be small in comparison to the cross sectional area of the tubing, which provides a high 'impedance' mismatch between cable and tubing. In popular science terms: compare this to a thin rope connected to a heavy rope. If you swing the thin rope, a travelling wave will propagate through the rope, when it reaches the heavy rope this wave will be largely reflected, instead of travelling along the heavy rope. This works two ways, if you swing the heavy rope the wave will also be reflected at the thin rope instead of travelling further along the thin rope. Thus, although the sonde is mechanically coupled to the installed tubing, it is effectively isolated, acoustically, from the noise generated by the fluid flow in the tubing. The dimensions, especially the diameter, and the material of the tether rods can be calculated to provide such acoustic isolation over the band of frequencies required to be sensed by the sonde, taking into account the choice of material for the rods.

Embodiments in accordance with the invention have the following advantages over the prior art:

i) The acoustic sensors remain acoustically decoupled from the flow noise;

ii) Potential damage to the sensor electrical wiring by tubing movement is prevented;

iii) A strong connection to the tubing is provided. The rod size and number can be adjusted to suit requirements;

iv) There is no low frequency resonance added in the seismic frequency band;

v) The rods can be fitted to any shaped clamp equipment; and vi) Deployment from the surface is enabled without any remote actuation equipment. Therefore, the tool may be dragged down from the surface during installation. No actuation mechanism, e.g. downhole pressure supply is required, and the need for a threaded section of tubing required by prior art systems, typically 1500 mm long and carrying the pre-assembled clamp system, is eliminated.

DESCRIPTION OF DRAWINGS

The invention will now be described by way of example with reference to the accompanying drawings, in which.

DETAILED DESCRIPTION

Figure 1:
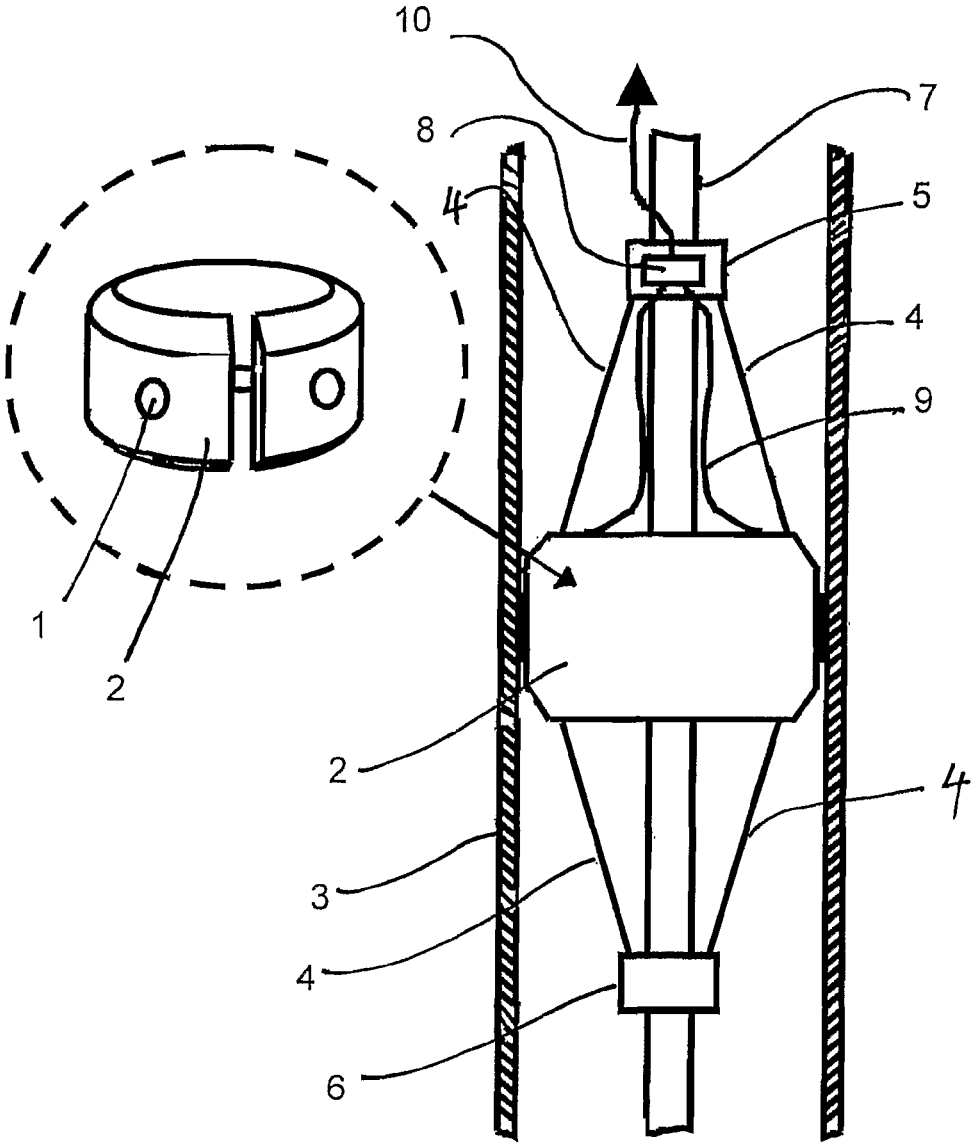
FIG. 1 shows a first embodiment of the sonde in position in a well, the sonde comprising a C-shaped ring clamp.

FIG. 1 shows a first embodiment of the invention wherein the sonde comprises a C-shaped spring clamp design as described in the patent application no. EP-A-1370891. Typically four acoustic sensors 1 are mounted in the C-shaped clamp 2. The clamp 2 may be positioned within the well casing 3 by being fitted over production tubing 7, compressed by a mechanical assembly and released hydraulically when the assembly has been lowered down the well casing 3, to the required depth down the well. Alternatively the clamp may be compressed (e.g. manually) and fitted over tubing 7 near the top of the well and then allowed to engage the well casing and simply slide down the well in contact with the casing 3 until it is in position. As shown in this embodiment, the C-shaped sonde clamp 2 is attached to thin rigid tether rods 4, typically six rods being used, i.e. three above and three below. The other ends of the rods are connected to attachment means 5 and 6 which are in turn affixed to the tubing 7. The attachments 5 and 6 may be soft-mounted to tubing 7, e.g. using a resiliently deformable material, such as a suitable polymer, between the attachment and the tubing, which acts to dampen acoustic vibration to prevent noise transfer between the tubing and the clamp, and hence to sensors 1. The attachment 5 also supports a distribution unit 8 which provides an electrical interface between the wires 9, from each of the acoustic sensors 1, and the cable 10 to the wellhead and its acoustic signal processing system. Since the sonde is mechanically coupled to the distribution unit, i.e. the distribution unit is secured relative to the sonde, any movement of the well casing relative to the tubing does not result in damage to the electrical wiring, which is a potential risk in conventional systems.

In the second of the above positioning methods, installation of the sonde is effected by fixing the whole assembly, consisting of the sonde clamp 2 with sensors 1 coupled to the attachments 5 and 6 by the tether rods 4, pre-wired to distribution unit 8 and cable 10, to the tubing 7, prior to lowering the tubing 7 down the well. With the assembly attached to the tubing 7, the clamp 1 is compressed manually to allow it to slip into the casing, facilitated by the chamfered edges of the clamp. The tubing may then be lowered down the well with the clamp 2 sliding down the casing 3, with the force to enable it to do so transmitted from the tubing 7 via the attachments 5 and 6 and the tether rods. This does not damage either the clamp or the well casing as the clamp is typically made of a very hard material, for example Inconel®, and also due to the lubricating effect of fluid in the well. Alternatively, the clamp may be retained in its compressed state until the correct position is reached down the well.

Figure 2:
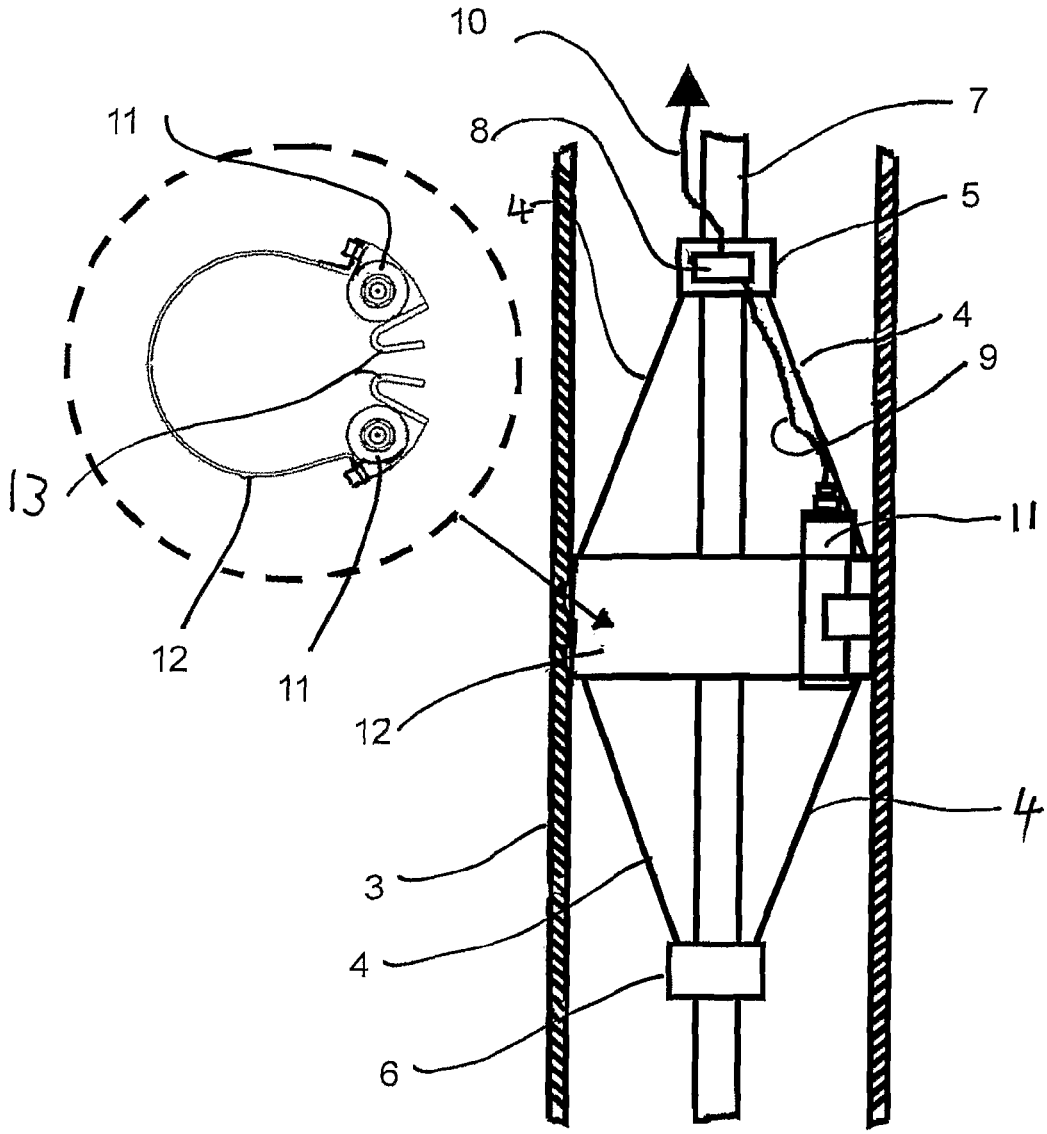
FIG. 2 shows a second embodiment in which the sonde comprises a different C-shaped clamp.

FIG. 2 shows a second embodiment of the invention applied to an alternative design of sonde C-shaped clamp which is also described in EP-A-1370891. In this case, sonde packs 11 each consisting of typically four sensors arranged in a tetrahedral configuration are attached to a spring clamp 12. In the same manner as in the first embodiment, the clamp is attached to typically six thin rigid tether rods 4, i.e. three above and three below, the other ends of the rods 4 connected to attachments 5 and 6 which are also affixed to the tubing 7 as in the first embodiment. The method of installation is somewhat different to the first embodiment though. The clamp shown in FIG. 2 is contracted and expanded by physical manipulation of the members 13 at the ends of the C-shape. In practice, a forked member (not shown) like in EP-A-1370891 is used to hold the members 13 together to contract the clamp until it is inserted into the well. The clamp may then either by positioned while the clamp is retracted and then expanded to hold it in position against the well casing, or expanded near the top of the well and pushed down to the desired position against the well casing. Expansion of the clamp is effected by removing the forked member from engagement with members 13, so that the clamp moves into the expanded state. Sliding the expanded clamp down the casing does not damage either the clamp or the well casing as the clamp is typically made of a very hard material, for example Inconel®, and also due to the lubricating effect of fluid in the well.

It should be noted that both forms of clamp provide substantial force to press the sonde to the well casing to ensure good acoustic coupling. Experimental work with a prototype has demonstrated that the sliding friction force within the casing is sufficiently low for the tether rods to adequately overcome these forces during installation.

It should be noted that the invention is not limited to the embodiments shown, and various alternatives are possible within the scope of the claims. For example, although the invention has been described with reference to C-shaped clamps, any design of clamp may be used which can have the rods attached thereto.

The invention claimed is:

1. A sonde for installation in a well comprising:

a clamp for engaging with the inner wall of a well casing, the clamp being fitted over a tubing passing through the clamp;

a securing device configured to secure the clamp to the tubing, the securing device comprising:

a first attachment device coupled to the tubing on one longitudinal side of the clamp and a second attachment device coupled to the tubing on an opposite longitudinal side of the clamp; and a first plurality of rods in which each rod is coupled to the one longitudinal side of the clamp and the first attachment device and a second plurality of rods in which each rod is coupled to the opposite longitudinal side of the clamp and the second attachment device.

2. A sonde according to claim 1, wherein each of the first and second attachment devices is soft mounted to the tubing via a resilient member.

3. A sonde according to claim 1, wherein at least one of the first and second attachment devices comprises electrical distribution means enabling an electrical connection between the sonde and wellhead components, the electrical distribution means being substantially fixed relative to the sonde.

4. A sonde according to claim 1, wherein the clamp is substantially C-shaped.

5. A sonde according to claim 1, wherein the clamp carries a sensor.

6. A sonde according to claim 1, wherein the clamp may be temporarily locked in a compressed position.

7. A sonde according to claim 1, wherein the clamp is deformably compressed when it is in a retracted position toward the tubing and the clamp is deformably extended when it is in an expanded position to engage with the casing, and wherein the securing device adapts to said compression and extension.

8. A sonde according to claim 1, wherein the clamp is substantially acoustically isolated from the tubing due at least in part to the securing device.

9. A method of installing a sonde in a well, comprising providing a sonde according to claim 1; and installing the sonde at a desired position in the well so that the clamp engages with the inner wall of the well casing.

10. A method according to claim 9, further comprising:

fitting the sonde to the tubing while the clamp is compressed;

expanding the clamp so that it contacts the inner wall of the well casing; and translating the sonde along the well to the desired position.

11. A method according to claim 9, further comprising:

translating the sonde along the well to the desired position while the clamp is compressed; and expanding the clamp so that it contacts the inner wall of the well casing at the desired position.

12. A method according to claim 9, wherein the clamp is substantially acoustically isolated from the tubing due at least in part to the securing device.

13. A method according to claim 9, wherein each of the first and second attachment devices is soft mounted to the tubing via a resilient member.

14. A method according to claim 9, wherein the sonde further comprises a distribution unit that provides an electrical interface between a sensor disposed on the clamp and a cable routed to a surface location.

* * * * *